US010004136B2

(12) United States Patent
McCrea

(10) Patent No.: US 10,004,136 B2
(45) Date of Patent: Jun. 19, 2018

(54) SATELLITE-BASED BALLISTIC MISSILE DEFENSE SYSTEM

(71) Applicant: Michael McCrea, Calgary (CA)

(72) Inventor: Michael McCrea, Calgary (CA)

( * ) Notice: Subject to any disclaimer, the term of this patent is extended or adjusted under 35 U.S.C. 154(b) by 225 days.

(21) Appl. No.: 15/008,520

(22) Filed: Jan. 28, 2016

(65) Prior Publication Data

US 2016/0345421 A1 Nov. 24, 2016

Related U.S. Application Data

(60) Provisional application No. 62/111,079, filed on Feb. 2, 2015.

(51) Int. Cl.

| | |
|---|---|
| ***H05H 3/06*** | (2006.01) |
| ***G21K 1/02*** | (2006.01) |
| ***F41H 11/02*** | (2006.01) |
| ***F41H 13/00*** | (2006.01) |
| *H05H 3/00* | (2006.01) |
| *G21K 1/00* | (2006.01) |
| *F41H 11/00* | (2006.01) |

(52) U.S. Cl.

CPC ..... *H05H 3/06* (2013.01); *F41H 11/02* (2013.01); *F41H 13/0043* (2013.01); *G21K 1/02* (2013.01)

(58) Field of Classification Search

CPC .. H05H 3/06; H05H 3/02; H05H 3/00; H05H 5/06; G21K 1/02; G21K 1/025; F41H 11/02; F41H 13/0043; G01N 23/221; H01J 3/02; G21G 4/02

USPC ..... 250/251

See application file for complete search history.

(56) References Cited

U.S. PATENT DOCUMENTS

| | | | | |
|---|---|---|---|---|
| 3,387,130 | A * | 6/1968 | Lacey | H05H 3/00 |
| 3,427,611 | A | 2/1969 | Enenstein | |
| 3,914,612 | A * | 10/1975 | Cason, Jr. | G21G 4/02 376/114 |
| 3,946,233 | A | 3/1976 | Erben et al. | |
| 4,320,298 | A * | 3/1982 | Buford, Jr. et al. | G01N 23/221 |
| 4,324,979 | A * | 4/1982 | Bewley | G21G 4/02 250/390.01 |
| 4,361,761 | A * | 11/1982 | Treglio | H01J 3/02 |
| 4,412,967 | A * | 11/1983 | Winterberg | H05H 5/06 |
| 4,700,068 | A * | 10/1987 | McClung et al. | H05H 3/02 |
| 4,701,616 | A * | 10/1987 | West et al. | H05H 3/00 |
| 5,198,607 | A | 3/1993 | Livingston et al. | |

(Continued)

OTHER PUBLICATIONS

P. G. O'Shea et al., "A Linear Accelerator in Space—The Beam Experiment Aboard Rocket"; Proceedings of the Linear Accelerator Conference 1990; Albuquerque, New Mexico, U.S.A.; pp. 739-742.*

*Primary Examiner* — Bernarr E Gregory

(57) ABSTRACT

A satellite-based missile defense system includes a neutron beam transmission tube, a beam generator disposed within the neutron beam transmission tube and operable to emit neutron beamlets from a neutron source. A first collimating plate is disposed within the neutron beam transmission tube and downstream from the beam generator. A second collimating plate is disposed within the neutron beam transmission tube and downstream from the first collimating plate. Neutron beams can be used to create gamma radiation and which can in-turn disable electronic equipment, such as that found in enemy aircraft, missile guidance systems, communication systems and/or the like.

17 Claims, 11 Drawing Sheets

(56) References Cited

U.S. PATENT DOCUMENTS

| | | | | |
|---|---|---|---|---|
| 5,468,970 | A * | 11/1995 | Kocsis | G21K 1/025 250/505.1 |
| 5,747,720 | A | 5/1998 | Schnurr et al. | |
| 5,835,545 | A * | 11/1998 | Turchi | H05H 3/00 |
| 6,587,486 | B1 | 7/2003 | Sepp et al. | |
| 6,809,307 | B2 | 10/2004 | Byren et al. | |
| 6,825,792 | B1 | 11/2004 | Letovsky | |
| 6,909,086 | B2 * | 6/2005 | Samukawa et al. | H05H 3/02 |
| 6,961,171 | B2 | 11/2005 | Byren et al. | |
| 7,381,943 | B2 * | 6/2008 | Lee et al. | H05H 3/02 |
| 7,504,982 | B2 | 3/2009 | Berg et al. | |
| 7,946,207 | B1 | 5/2011 | Porter et al. | |
| 8,199,405 | B2 | 6/2012 | Geidek et al. | |
| 8,415,600 | B2 | 4/2013 | Hutchin | |
| 8,461,516 | B2 | 6/2013 | Dent | |
| 8,757,552 | B1 | 6/2014 | Martin | |
| 8,941,042 | B2 | 1/2015 | Hutchin | |
| 8,991,766 | B1 | 3/2015 | Martin | |
| 9,074,853 | B2 | 7/2015 | Kong et al. | |
| 2008/0080659 | A1 | 4/2008 | Leung et al. | |
| 2009/0095895 | A1 * | 4/2009 | Dent | H05H 3/06 |
| 2013/0148770 | A1 * | 6/2013 | Mofakhami | H05H 3/06 376/107 |
| 2014/0218790 | A1 | 8/2014 | Hagen | |

* cited by examiner

SATELLITE-BASED BALLISTIC MISSILE DEFENSE SYSTEM

CROSS-REFERENCE TO RELATED APPLICATION

This application claims the benefit of U.S. Provisional Application No. 62/111,079, filed Feb. 2, 2015, the entirety of which is incorporated herein by reference.

FIELD OF THE INVENTION

The invention relates to satellite-based neutron beam transmission systems. Other embodiments provide neutron-beam weapons systems.

BACKGROUND OF THE INVENTION

The existence of the neutron was discovered in 1932 by James Chadwick. Neutrons can be generated in many ways, such as, by way of example, certain types of radioactive decay involving neutron emission and certain types of nuclear reactions.

There is a general desire to provide satellites with the capability to transmit controllable neutron beams. Such neutron beams can be used to create gamma radiation and to disable electronic equipment, such as that found in enemy aircraft, missile guidance systems, communication systems and/or the like. Such neutron beams can also be used as anti-personnel weapons.

The foregoing examples of the related art and limitations related thereto are intended to be illustrative and not exclusive. Other limitations of the related art will become apparent to those of skill in the art upon a reading of the specification and a study of the drawings.

SUMMARY OF THE INVENTION

In view of the foregoing disadvantages inherent in the known types of systems now present in the prior art, the present invention provides a new satellite-based ballistic missile defense system wherein the same can be used to disable a ballistic missile while the missile is in flight by exposing the missile to a neutron beam.

In general, in one aspect, a satellite-based ballistic missile defense system is provided. The system includes a neutron beam transmission tube; a beam generator disposed within the neutron beam transmission tube, the beam generator operable to emit neutron beamlets from a neutron source; a first collimating plate disposed within the neutron beam transmission tube and downstream from the beam generator; and a second collimating plate disposed within the neutron beam transmission tube and downstream from the first collimating plate In general, in another aspect, a satellite-based ballistic missile defense system is provided. The system includes an orbiting satellite and a neutron beam transmission tube on the satellite. A neutron beam generator is disposed within the neutron beam transmission tube and is operable to emit neutron beamlets from a neutron source. A first collimating plate is disposed within the neutron beam transmission tube and downstream from the beam generator. The first collimating plate including a first array of collimating tubes through which the neutron beamlets are caused to pass through thereby forming secondary neutron beams. A second collimating plate is disposed within the neutron beam transmission tube and downstream from the first collimating plate. The second collimating plate including a second array of collimating tubes through which the secondary neutron beams are caused to pass through thereby forming a final neutron beam which is discharged from the neutron beam transmission tube.

In general, in another aspect, a satellite-based ballistic missile defense system is provided. The system includes an orbiting satellite and a neutron beam transmission system on the orbiting satellite. The neutron beam transmission system includes telescoping arms; a neutron beam generator supported by the neutron beam transmission system at one end of the telescoping arms, the neutron beam generator operable to emit a neutron beam from a neutron source; a filter plate supported at a second end of the telescoping arms at a spaced distance from the neutron beam generator and in alignment with a neutron beam emitted from the neutron beam generator; and wherein the telescoping arms are operable to increase or decrease the spaced distance between the neutron beam generator and the filter plate.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
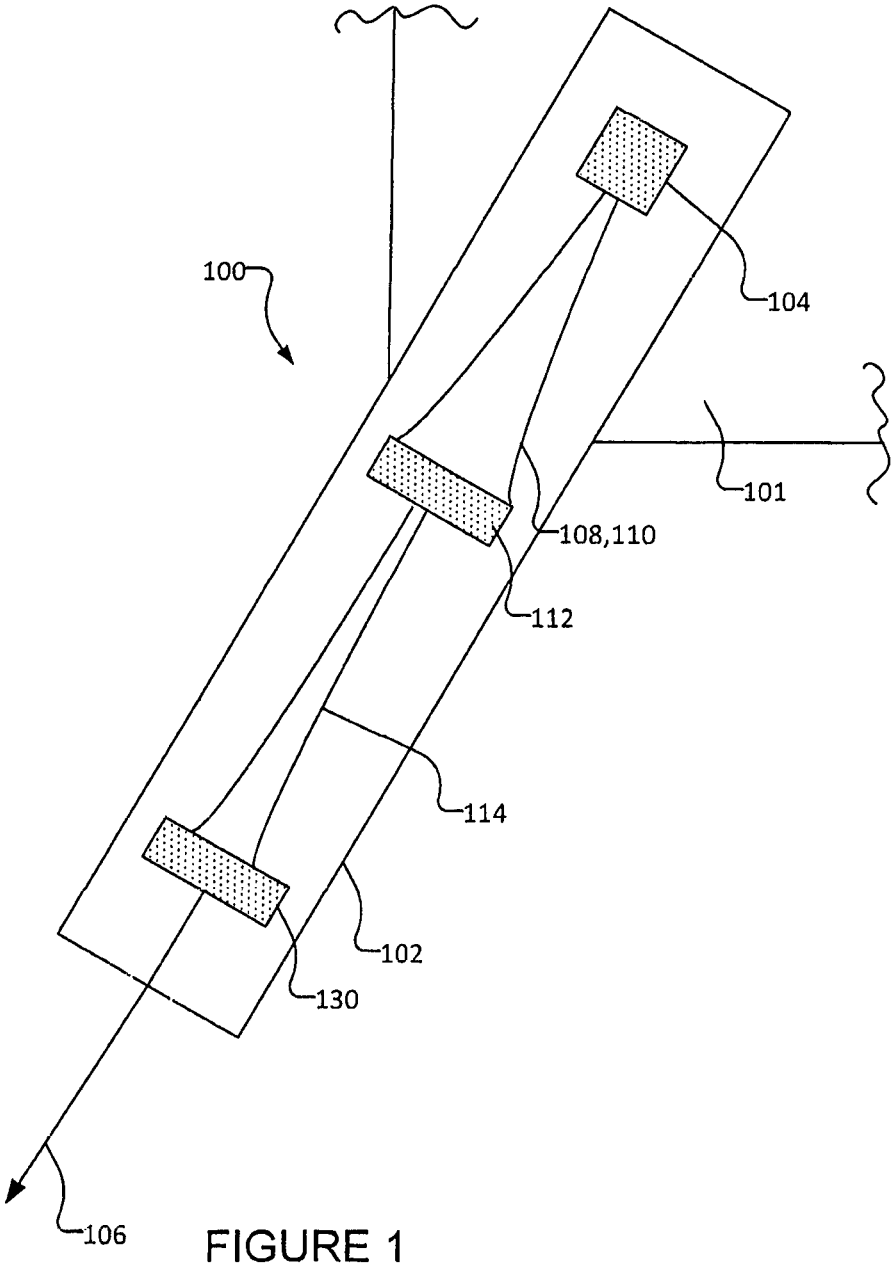
FIG. 1 is a schematic cross-sectional depiction of a satellite-based neutron beam transmission system according to a particular embodiment.

FIG. 1 is a schematic cross-sectional depiction of a satellite-based neutron beam transmission system 100 according to a particular embodiment. System 100 comprises an elongated transmission tube 102 mounted in a relatively low orbit (e.g. 200 km-500 krn) satellite 101 (only a portion of which is shown in FIG. 1). In some embodiments, transmission tube 102 may be in a range of 20 m-30 m in length, although tube 102 could have other lengths. System 100 may be used as a weapon by emitting a neutron beam 106. Neutron beams 106 emitted by system 100 can provide anti-personnel weapons and/or anti-electronics (e.g. anti-computer) weapons. By way of non-limiting example, neutron beams 106 can be used to create gamma radiation and which can in-turn disable electronic equipment, such as that found in enemy aircraft, missile guidance systems, communication systems and/or the like.

Figure 2A:
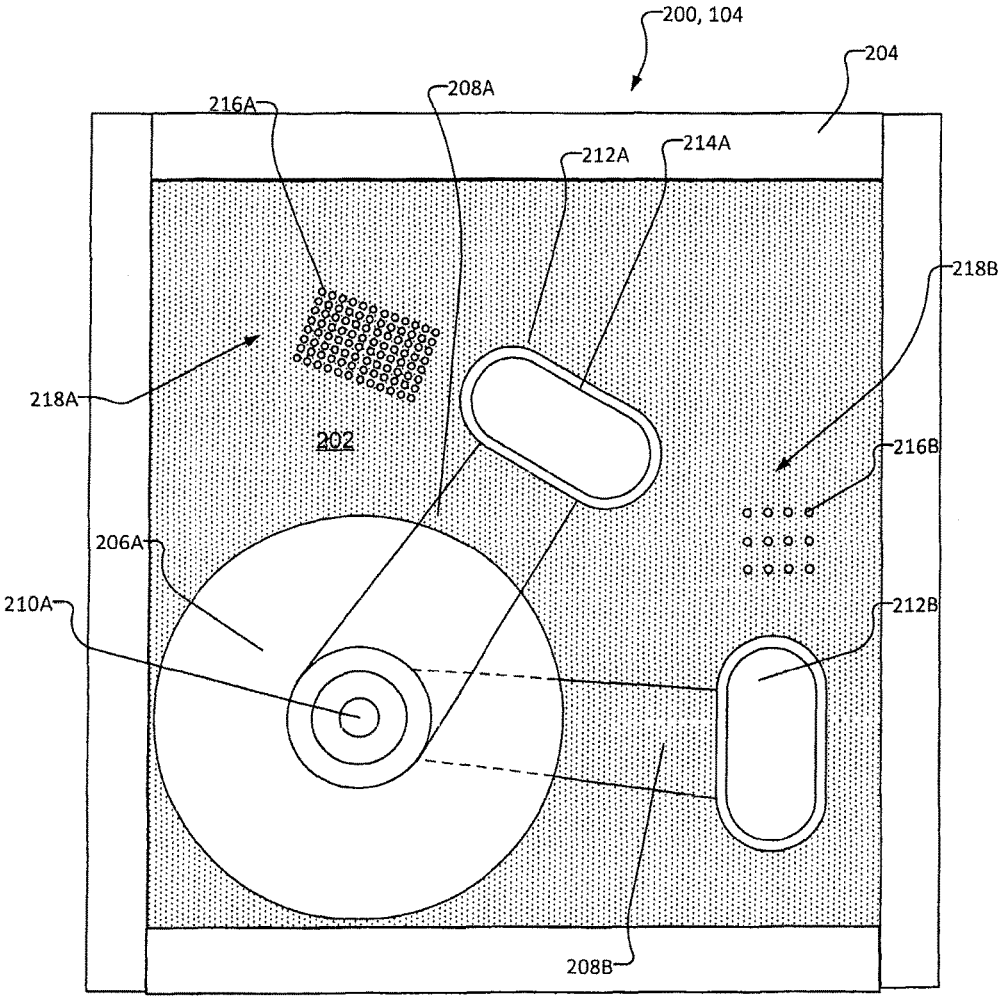
FIG. 2A is a partial schematic view of a multi-beamlet generator component of a beam generator suitable for use with the FIG. 1 transmission system or any of the other transmission systems described herein.
Figure 2B:
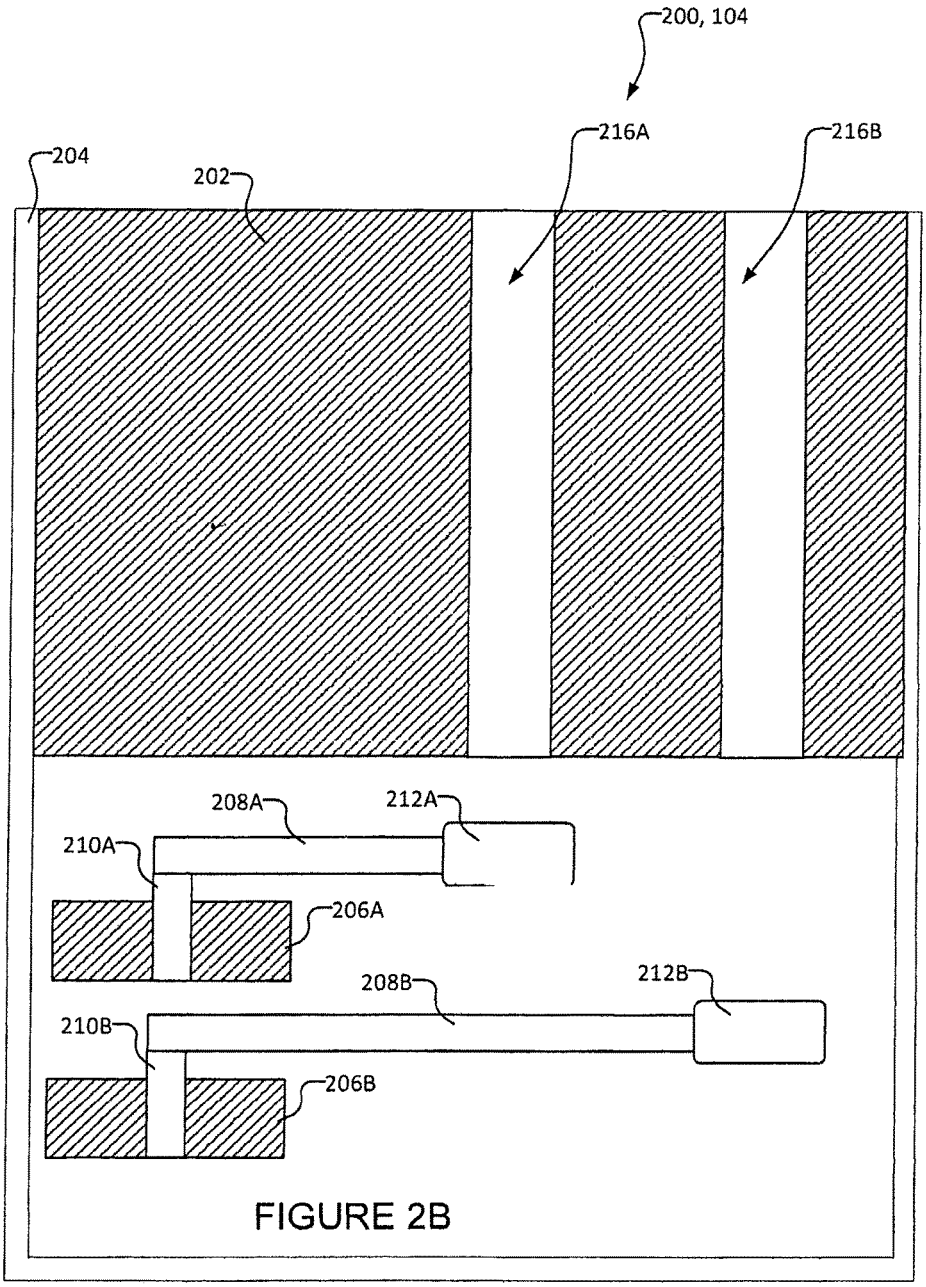
FIG. 2B is a schematic partial cross-sectional view of the FIG. 2A multi-beamlet generator.

As can be seen in FIG. 1, neutron beam transmission system 100 is equipped with a beam generator 104. FIGS. 2A and 2B (together, FIG. 2) are respectively a partial schematic view and a schematic cross-sectional view of a multi-beamlet generator component 200 of beam generator 104 according to a particular embodiments. In some embodiments, beam generator 104 comprises a single multi-beamlet generator 200. However, in some embodiments, beam generator 104 may comprise any suitable number (e.g. four) multi-beamlet generator components similar to multi-beamlet generator component 200. Multi-beamlet generator component 200 comprises a lead plate 202 that is set in a suitable frame 204.

Multi-beamlet generator component 200 also comprises one or more (e.g. two) motors 206A, 206B (with optional transmissions (not shown) for speed/torque control) having arm 208A suitably attached to the motor shaft 210A for controllable rotational movement about shaft 210A and arm 208B suitably attached to the motor shaft 210B for controllable rotational movement about shaft 210B. Arm 208A supports a neutron source 212A, which, in the illustrated embodiment, is housed in metal frame 214A.

In one particular embodiment, neutron source 212A comprises radioactive uranium, although in other embodiments, neutron source 212A may comprise other suitable sources of neutrons. Similarly, arm 208B of the illustrated embodiment arm 208B supports a neutron source 212B, which, in the illustrated embodiment, is housed in metal frame 214B. In one particular embodiment, neutron source 212B comprises radioactive uranium, although in other embodiments, neutron source 212B may comprise other suitable sources of neutrons. In some embodiments, second motor 206B, second arm 208B and second neutron source 212B are optional. In some embodiments, multi-beamlet generator 200 may comprise more than two motors 206, corresponding arms 208 and corresponding neutron sources 212.

Lead plate 202 is apertured by an aperture array 216A comprising a suitable plurality of tubes 218A. For clarity, aperture array 216A is shown schematically as a single aperture 216A in FIG. 2B. In some embodiments, lead plate 202 may have a thickness on the order of 0.5 cm-2.5 cm and tubes 218A may have similar lengths. For the purposes of exemplary illustration, array 216A shown in FIG. 2 comprises 96 tubes 218A. However, in general, tube array 216A may comprise any desired number of tubes 218A to produce desired beam characteristics.

By way of non-limiting example, in some embodiments where multi-beamlet generator 200 is used as a weapon, tube array 216A may comprise 102-106 tubes 218A. As another non-limiting example, in some embodiments, where multi-beamlet generator 200 is used for communication purposes, tube array 216A may comprise fewer than 100 tubes 218A. In some embodiments, aperture array 216A may have a cross-sectional dimension on the order of 0.01 m2-1.0 m2. In some embodiments, individual tubes 218A may have cross-sectional dimensions on the order of 10 μm2-104 μm2. In some embodiments, individual tubes 218A may have cross-sectional dimensions on the order of 103 μm2-2.5×104 μm2.

The side of neutron source 212A facing plate 202 and tubes 218A is not covered by frame 214A, so that neutron source 212A can emit a steady stream of neutrons, some of which enter tubes 218A and become corresponding initial neutron beamlets 110A (not shown in FIG. 2)—i.e. one initial neutron beamlet 110A for each tube 218A in tube array 216A. When emitted from neutron sources 212A, neutrons may be travelling at speeds in a vicinity of 2×104 miles per second. The spacing between tubes 218A and the diameters of tube 218A may be selected such that the motor 206A may be controlled such that neutron source 212A may pass (and/or stop) over tube array 216A in a manner which permits neutrons emitted from neutron source 212A to enter tubes 218A. Neutrons that do not enter tubes 218A are absorbed in plate 202. The plurality of initial beamlets 110A generated by each multi-beamlet generator component 200 may be referred to as a beamlet set 108. A beamlet set 108 is shown emanating from beam generator 104 in FIG. 1.

FIG. 2 also illustrates an optional second motor 206B and second arm 208B which move a second neutron source 212B over a second tube array 216B of tubes 218B. Tube array 216B may comprise a lesser number of tubes 218B, a lesser density of tubes 218B and/or a lesser tube cross-section than tube array 216A and may be used for different applications. By way of non-limiting example, second motor 206B, second arm 208B, second neutron source 212B and second tube array 216B may be used for communications applications in some embodiments. Aside from the number, density and/or cross-sectional area of tubes 218B in tube array 216B, the functionality of second motor 206A, second arm 208B, second neutron source 212B and second tube array 216B may be substantially similar to that of motor 206A, arm 208A, neutron source 212A and tube array 216A as described herein. Characteristics of motor 206A, arm 208A, neutron source 212A and tube array 216A described herein should be understood to apply to second motor 206A, second arm 208B, second neutron source 212B and second tube array 216 with appropriate modification.

Each beamlet set 108 can be rapidly turned on/off by causing motor 206A to move arm 208A such that neutron sources 212A is located over tube array 216A or over a non-apertured portion of plate 202. This ability to turn beamlet sets 108 on and off may be used to precisely control neutron beam 106 emanating from system 100 (FIG. 1)—e.g. to minimize collateral damage in weapons applications, to modulate neutron beam 106 for communications applications, and/or the like.

The number of beamlet sets 108 generated by beam generator 104 at a given time may depend on the number of multi-beamlet generator components 200 present in beam generator 104. As discussed above, in some embodiments, beam generator 104 comprises four multi-beamlet generator components 200, each of which may simultaneously emit a corresponding beamlet set 108, with each beamlet set comprising a plurality of initial neutron beamlets 110A. Referring back to FIG. 1, the beamlet sets 108 emitted from beam generator 104 at a given time may be referred to collectively as initial neutron beam 110. In some embodiments, beam generator 104 comprises only a single multi-beamlet generator component 200, in which case initial neutron beam 110 may comprise a single beamlet set 108.

Figure 3A:
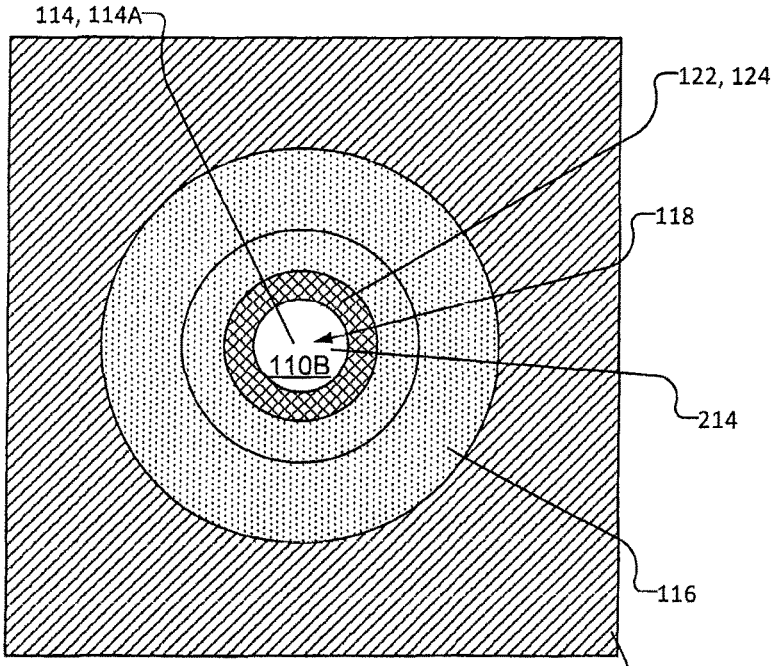
FIGS. 3A and 3B are respectively a beamlet's eye view and a cross-sectional view of a per-beamlet portion of a narrow plate suitable for use with the FIG. 1 transmission system or any of the other transmission systems described herein.
Figure 3B:
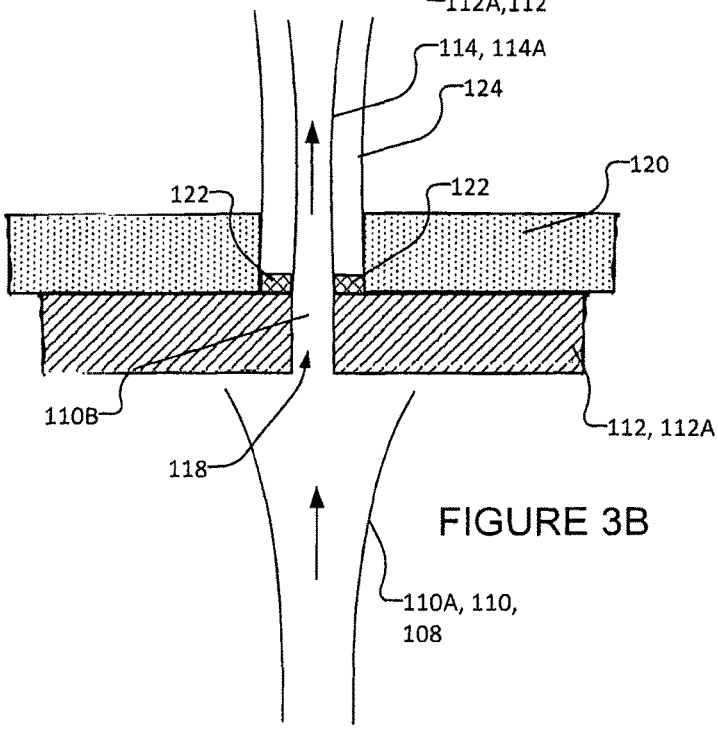

Referring to FIG. 1, initial neutron beam 110 impinges on narrow plate 112, which narrows (e.g. collimates) initial neutron beam 110 to result in secondary neutron beam 114 by absorbing neutrons that stray from the desired collimated path. FIGS. 3A and 3B (collectively, FIG. 3) respectively depict a beamlet's eye view and a cross-sectional view of a per-beamlet portion 112A of a narrow plate 112 suitable for use with transmission system 100 (FIG. 1) or any of the other transmission systems described herein.

FIG. 3 schematically depicts a single initial beamlet 110A impinging on a corresponding portion 112A (referred to herein as a per-beamlet portion 112A) of narrow plate 112 and a corresponding secondary neutron beamlet 114A which emanates from narrow plate portion 112A. FIG. 3 shows a single initial beamlet 110A, a per-beamlet portion 112A of narrow plate 112 and a single secondary neutron beamlet 114A. It will be understood by those skilled in the art that each multi-beamlet generator component 200 (FIG. 2) generates a plurality of initial beamlets 110A. Narrow plate 112 may comprise a plurality of features similar to those described and discussed for per-beamlet portion 112A—e.g. narrow plate 112 may comprise a per-beamlet portion similar to per-beamlet portion 112A for each of initial neutron beamlets 110A. In embodiments, comprising a plurality of multi-beamlet generator components 200 and a corresponding plurality of multi-beamlet sets 108, narrow plate 112 may comprise a plurality of features similar to those described and discussed for per-beamlet portion 112A for each initial neutron beamlet 110A of each multi-beamlet set 108.

In some embodiments, the distance between beam generator 104 and narrow plate 112 may be on the order of 0.25 m-20 m. FIG. 3A shows the footprint 116 of initial neutron beamlet 110A impinging on plate portion 112A. Narrow plate portion 112A is made of lead (e.g. with thickness on the order of 0.5 cm-2.5 cm in some embodiments) and blocks initial neutron beamlet 110A with the exception of portion 110B which impinges on collimating tube 118 extending through narrow plate portion 112A. Some of the portion 110B of initial neutron beamlet 110A which impinges on collimating tube 118 travels through narrow plate portion 112A and becomes secondary neutron beamlet 114A.

In the illustrated embodiment, narrow plate 112 comprises one per-beamlet portion 112A and one collimating tube 118 for each initial beamlet 110A to resulting in one corresponding secondary neutron beamlet 114A. In some such embodiments, collimating tubes 118 may have cross-sectional areas on the order of 103 μm2-2.5×104 μm2. In such embodiments, collimating tubes 118 of narrow plate 112 may be aligned carefully with corresponding tubes 218 of each multi-beamlet generator component 200 so as to receive maximum energy of their corresponding initial neutron beamlets 110A and to result in corresponding secondary neutron beamlets 114A having maximum energy. In some embodiments, narrow plate 112 may comprise different numbers of collimating tubes 118 and individual collimating tubes 118 need not correspond to initial neutron beamlets 110A on a one-to-one basis. For example, in some embodiments, narrow plate 112 may comprise a plurality of collimating tubes 118 for each beamlet 110A and in some embodiments narrow plate 112 may comprise a number of collimating tubes 118 that is fewer than the number of initial neutron beamlets 110A. In such embodiments, the number of secondary neutron beamlets 114A may be different than the number of initial neutron beamlets 110A. In some embodiments, collimating tubes 118 are sufficiently spaced apart from one another that neutrons from other (e.g. non-aligned) initial neutron beam lets 110A are unlikely to travel into or through such collimating tubes 118. In other embodiments, this is not necessary and neutrons from other (e.g. non-aligned) initial neutron beamlets 110A may travel through other collimating tubes 118. In some embodiments, the cross-sectional area of the aperture portion of narrow plate 112 (i.e. the cross-sectional area of narrow plate 112 occupied by collimating tubes 118) is in a range of 0.01 m2-1.0 m2.

Beamlets 114A emitted from narrow plate 112 may be referred to as secondary neutron beamlets 114A. It will be appreciated that, because of their travel through collimating tubes 118, secondary neutron beamlets 114A are relatively more collimated than initial neutron beamlets 110A. The combination of secondary neutron beamlets 114A may be referred to herein as a secondary neutron beam 114.

In the illustrated embodiment, each narrow plate portion 112A comprises an optional secondary radiation source 122, which may have the annular shape shown in FIG. 3. In the illustrated embodiment, secondary neutron source 122 is housed in secondary portion 120 of narrow plate portion 112A. Secondary neutron source 122 has a cross-sectional area that is greater than that of collimating tube 118 and is used to generate an insulating beamlet 124 around secondary neutron beamlet 114A. Insulating beamlet 124 may be used to interact with non-target particles (e.g. atmospheric particles) which may otherwise interact with the neutron beam and reduce the number of neutrons available in a vicinity of a target. Secondary neutron source 122 and insulating beamlet 124 are optional. Unless the context dictates otherwise, references to secondary neutron beamlets 114A and/or secondary neutron beam 114 in the remainder of this disclosure may include secondary neutron beamlets and/or secondary beams with or without insulating beam 124.

Figure 4A:
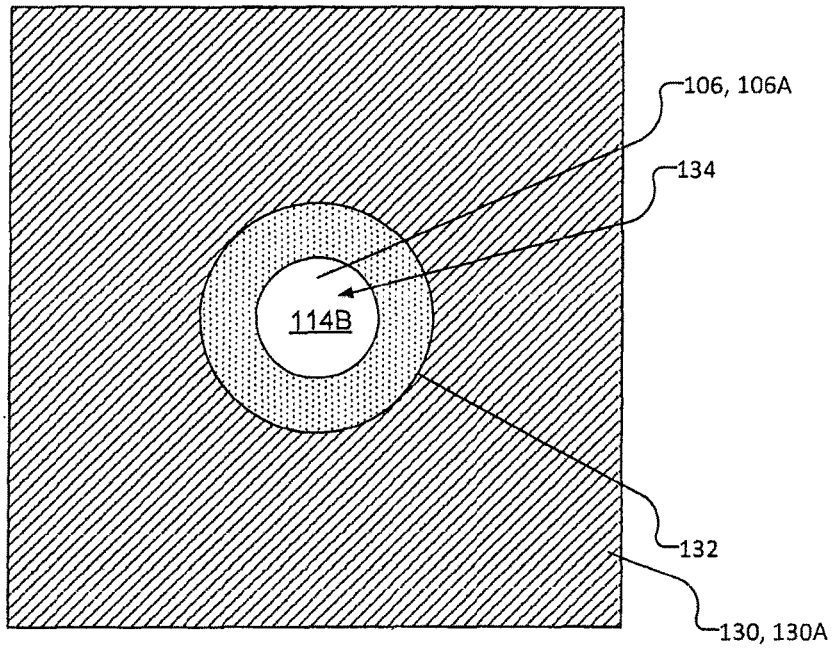
FIGS. 4A and 4B are respectively a beamlet's eye view and a cross-sectional view of per-beamlet portion of a wide plate suitable for use with the FIG. 1 transmission system or any of the other transmission systems described herein.
Figure 4B:
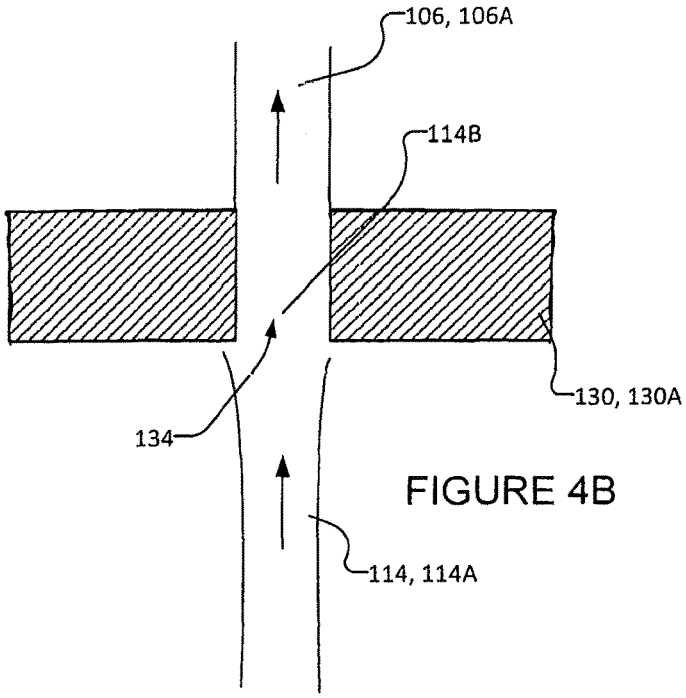

Referring to FIG. 1, secondary neutron beam 114 (with optional insulating beamlets 124) impinges on wide plate 130 which further narrows (e.g. collimates) secondary neutron beam 114 to result in final neutron beam 106 by absorbing neutrons that stray from the desired collimated path. FIGS. 4A and 4B (collectively, FIG. 4) respectively depict a beamlet's eye view and a cross-sectional view of a per-beamlet portion 130A of a wide plate 130 suitable for use with transmission system 100 (FIG. 1) or any of the other transmission systems described herein. FIG. 4 schematically depicts a single secondary beamlet 114A impinging on a corresponding portion 130A (referred to herein as a per-beamlet portion 130A) of wide plate 130 and a corresponding final beamlet 106A which emanates from wide plate portion 130A. FIG. 3 shows a single secondary beamlet 114A, a per-beamlet portion 130A of wide plate 130 and a single final neutron beamlet 106A. It will be understood by those skilled in the art that a plurality of secondary beamlets 114A may emanate from narrow plate 112. Wide plate 130 may comprise a plurality of features similar to those described and discussed for per-beamlet portion 130A—e.g. wide plate 130 may comprise a per-beamlet portion similar to per-beamlet portion 130A for each of the secondary neutron beamlets 114A.

In some embodiments, the distance between narrow plate 112 and wide plate 130 may be on the order of 0.25 m-20 m. FIG. 4A shows the footprint 132 of secondary neutron beamlet 114A impinging on wide plate portion 130A. Wide plate portion 130A is made of lead (e.g. with thickness on the order of 0.5 cm-2.5 cm in some embodiments) and blocks secondary neutron beamlet 114A with the exception of portion 114B which impinges on collimating tube 134 extending through wide plate portion 130A. Some of the portion 114B of secondary neutron beamlet 114A which impinges on collimating tube 134 travels through wide plate portion 130A and becomes final neutron beamlet 106A.

In the illustrated embodiment, wide plate 130 comprises one per-beamlet portion 130A and one collimating tube 134 for each secondary beamlet 114A to resulting in one corresponding final neutron beamlet 106A. In some such embodiments, collimating tube 134 of wide plate portion 130A may generally be larger (in cross-section) than its corresponding collimating tube 118 of narrow plate portion 112A. In some such embodiments, for example, collimating tubes 134 may have 1.25-3 times the cross-sectional area of corresponding collimating tubes 118.

In some such embodiments, collimating tubes 134 may have cross-sectional areas in a range of 0.04 m2-4.0 m2. In such embodiments, collimating tubes 134 of wide plate 130 may be aligned carefully with corresponding tubes 118 of narrow plate 112 to receive maximum energy of their corresponding secondary neutron beamlets 114A and to result in corresponding final neutron beamlets 106A having maximum energy. In some embodiments, wide plate 130 may comprise different numbers of collimating tubes 134 and individual collimating tubes 134 need not correspond to secondary neutron beamlets 114A on a one-to-one basis. For example, in some embodiments, wide plate 130 may comprise a plurality of collimating tubes 134 for each secondary beamlet 114A and in some embodiments wide plate 130 may comprise a number of collimating tubes 134 that is fewer than the number of secondary neutron beamlets 114A. In such embodiments, the number of final neutron beamlets 106A may be different than the number of secondary neutron beamlets 114A. In some embodiments, collimating tubes 134 are sufficiently spaced apart from one another that neutrons from other (e.g. non-aligned) secondary neutron beamlets 114A are unlikely to travel into or through such collimating tubes 134. In other embodiments, this is not necessary and neutrons from other (e.g. non-aligned) secondary neutron beamlets 114A may travel through other collimating tubes 134.

Final beamlets 106A emitted from wide plate 130 may, together, form a final neutron beam 106 that is emitted from wide plate 130. It will be appreciated that after having passed through narrow plate 112 and wide plate 130, final neutron beamlets 106A (and the corresponding final neutron beam 106) are relatively highly collimated.

Figure 5:
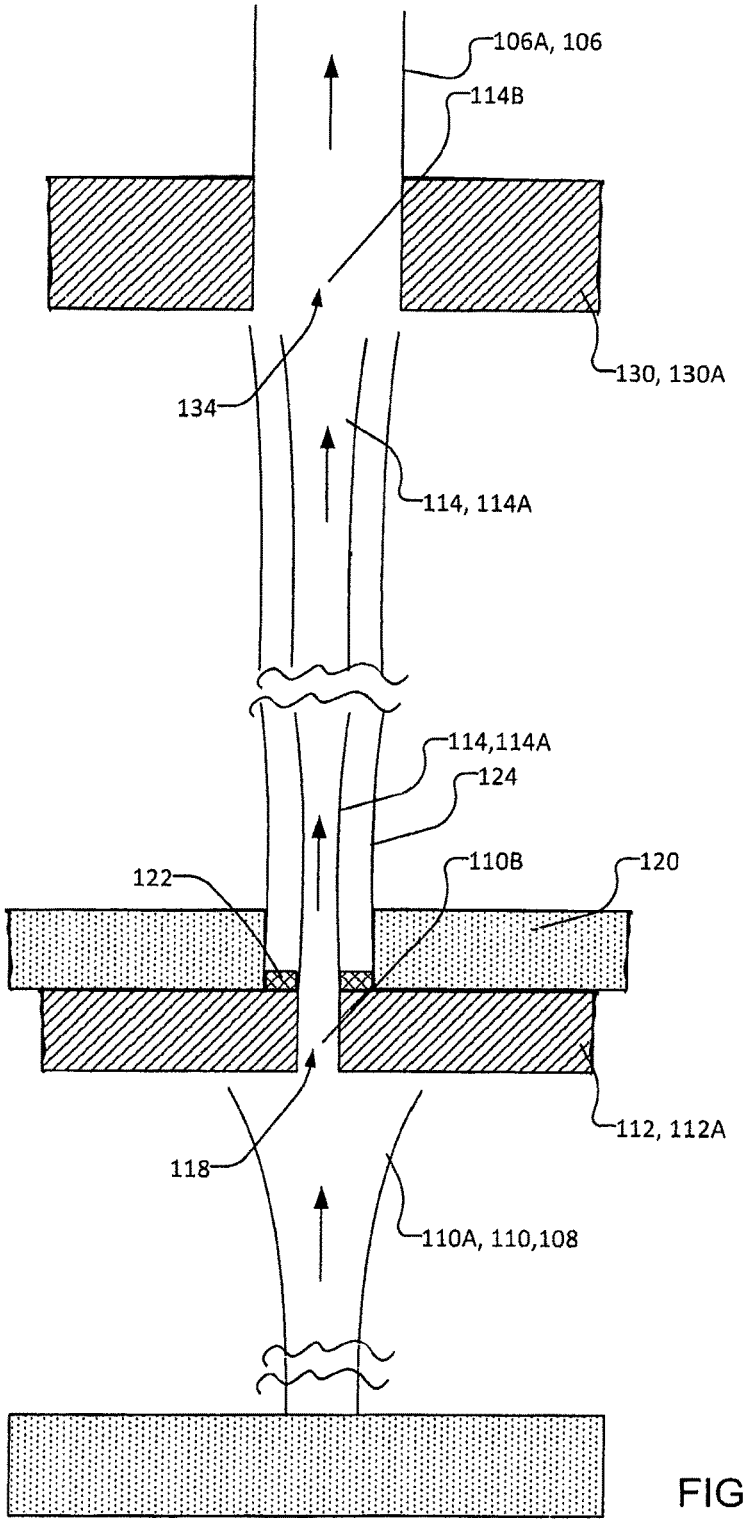
FIG. 5 is a cross sectional view of a per-beamlet portion the FIG. 1 beam transmission system showing an initial neutron beamlet emanating from the beam generator, passing through the narrow plate and passing through the wide plate.

FIG. 5 is a cross sectional view of a per-beamlet portion of the FIG. 1 beam transmission system 100 according to a particular embodiment showing an initial neutron beamlet 110A emanating from beam generator 104, passing through narrow plate portion 112A (where it is collimated to provide corresponding secondary neutron beamlet 114 and where insulating beam 124 is generated) and then passing through wide plate portion 130A (where it is further collimated to provide corresponding final beamlet 106A). In some embodiments, where the distance between lead plate 202, narrow plate 112 and wide plate 130 increases, it may become relatively more important to align tubes 216A, 118, 134 with one another to achieve maximum collimation, although this is not necessary, as explained above, and there may be different numbers of tubes 216A, 118, 134 which may or may not be aligned with one another.

Figure 6:
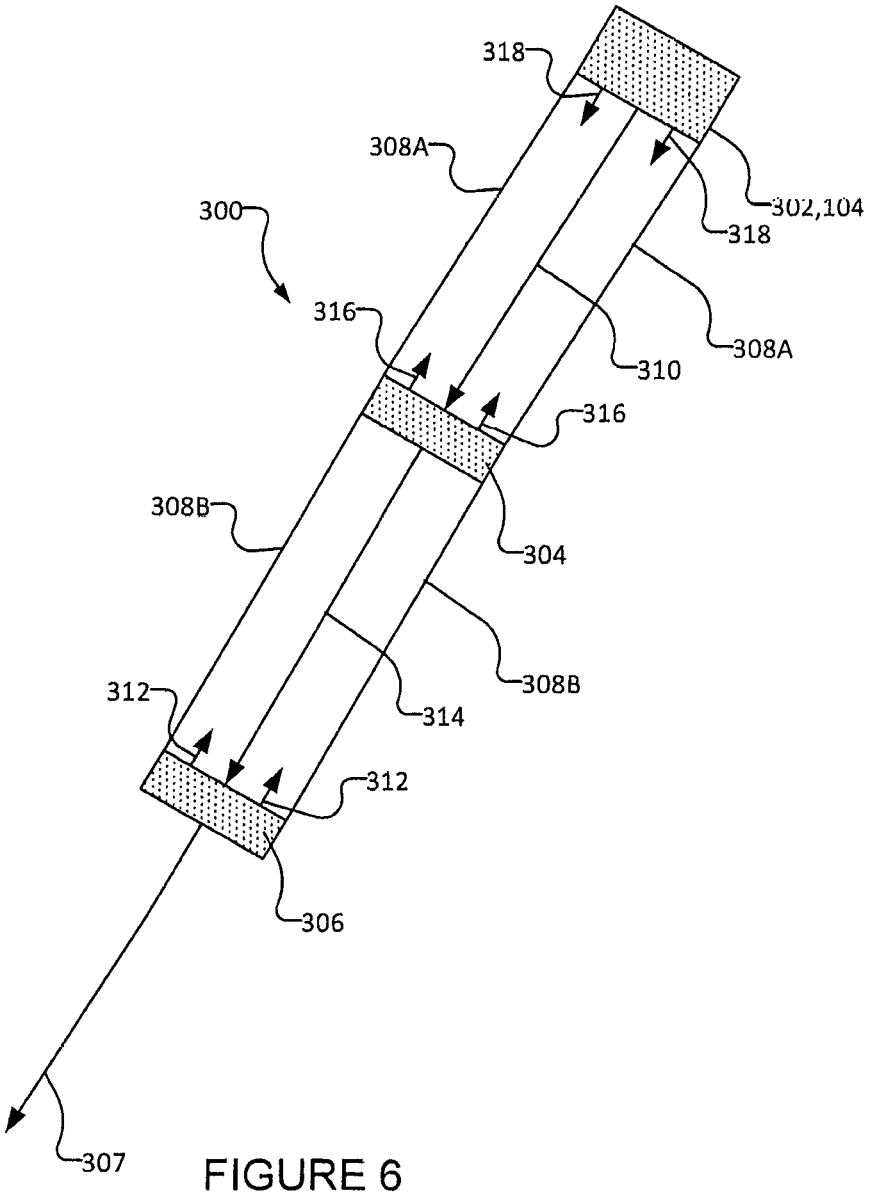
FIG. 6 is a schematic cross-sectional depiction of a satellite-based neutron beam transmission system according to another particular embodiment.

FIG. 6 is a schematic cross-sectional depiction of a satellite-based neutron beam transmission system 300 according to another particular embodiment. System 300 of the FIG. 6 embodiment comprises three satellites 302, 304, 306 which are generally functionally analogous to radiation source 104, narrow plate 112 and wide plate 130 described above and which can be arranged to provide external radiation tubes (explained in more detail below) that can be in a range of several hundred to several thousands (e.g. 200-10,000) of meters long. These satellites 302, 304, 306 can be in geosynchronous orbit at relatively high altitudes (e.g. 10,000 km-50,000 km above the surface of the earth). Such lengths for external radiation tubes can be desirable because the longer the external radiation tube, the greater the collimation of the resultant neutron beam 307 (e.g. the narrower the solid angle arc subtended by neutron beam 307). Satellites 302, 304, 306 may be oriented and positioned relative to one another by cables 308A which extend between satellites 302, 304, by cables 308B which extend between satellites 304, 306 and by (schematically depicted) rocket thrusters 312, 316, 318. The thrust from thrusters 312, 316 may counterbalance the thrust from thrusters 318 and cables 308A, 308B (collectively, cables 308) may prevent satellites 302, 304, 306 from drifting too far apart. Such relative positioning and orientation may be used to provide external radiation tubes. In currently preferred embodiments, thrusters 312, 316, 318 may be controlled such that there is only enough tension to keep cables 308 straight.

In some embodiments, the relative position and orientation of satellites 302, 304, 306 may be controlled primarily during (or just preceding) the transmission of a neutron beam 307. At other times, satellites 302, 304, 306 may be located relatively proximate to one another. Satellite 302 may be configured to have at least approximately the same mass as the combination of satellites 304, 306. Satellites 304, 306 may each have a plurality (e.g. four) reels (not shown) which may wind up cables 308 when satellites 302, 304, 306 are relatively more proximate to one another (e.g. when a neutron beam 307 is not being transmitted).

Satellites 302, 304, 306 may move toward one another or away from one another in general alignment with neutron beam 307 that they produce. When satellites 302, 304, 306 are separating from one another, the momentum associated with thrusters 318 may be approximately equal to the momentum from thrusters 312, 316 in combination. In some embodiments, the satellites 304, 306 move away from satellite 302 in a first stage to a suitable distance (e.g. 800 meters apart) and then, in a second stage, satellite 306 moves away from satellite 304 by a suitable distance (e.g. 1600 meters). In some embodiments, the first stage of the operation generates sufficient momentum to perform the second stage of the operation without additional use of thrusters 312, 316, 318, although this is not necessary and any of thrusters 312, 316, 318 may be used in the second stage of the operation. Cables 308 may come unreeled from their reels as the first and second stages (respectively) of elongation are performed.

Satellite 302 may be provided with a beam generator 104 similar to that discussed above in connection with FIGS. 1 and 2. Satellite 304 may be configured to perform the role of narrow plate 112 described above in connections with FIGS. 1 and 3 and satellite 306 may be configured to perform the role of wide plate 130 described above in connection with FIGS. 1 and 4. In some embodiments, the alignment between satellites 302, 304, 306 can be adjusted (e.g. using small rocket thrusters (not shown) when satellites 302, 304, 306 are spaced apart from one another to facilitate this functionality. In this manner, system 300 can generate a neutron beam 307 having similar properties to that of beam 106 discussed above for FIG. 1.

Figure 7:
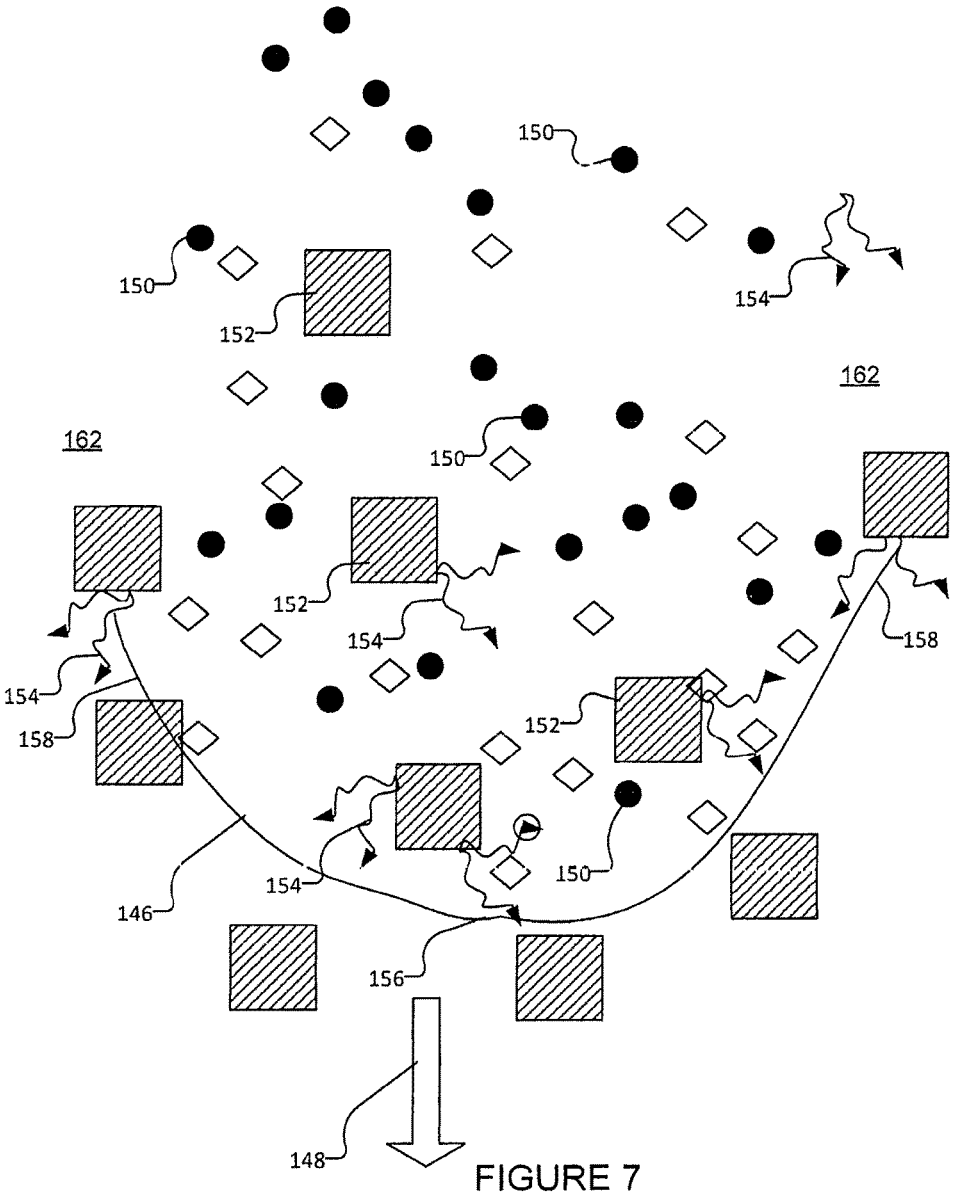
FIG. 7 is a schematic cross-sectional view of a neutron beam generated by any of the neutron beam transmission systems described here as it travels through the atmosphere.

FIG. 7 is a schematic magnified depiction of neutron beam 146 traveling in the direction of arrow 148. Neutron beam 146 may be generated by any of the neutron beam transmission systems described herein. Neutron beam 146 may comprise one or more constituent neutron beamlets (e.g. beamlets 108 discussed above with respect to FIG. 1). Such beamlets may join together to become, effectively, a wider single beam 146 of neutrons after traveling hundreds or thousands of kilometers. Such beamlets may join to produce the composite neutron beam 146 because the beamlets start close together and then they evenly spread out. FIG. 7 shows neutron beam 106 penetrating the outer atmosphere where the neutrons 150 (schematically depicted as circles in FIG. 7) in beam 146 interact with air molecules 152 (schematically depicted as squares in FIG. 7).

In some applications, beam 146 will penetrate the outer atmosphere when traveling to a target at or near the surface of the earth (not shown in FIG. 7). However, this is not necessary and, in some applications, such as where the target is a missile and/or the like, beam 146 need not be directed at the surface of the earth per se, but may nevertheless pass through a portion of the earth's atmosphere. When beam 146 passes through the air in the atmosphere or through any solid object (e.g. an aircraft or missile body), collisions between neutrons 150 and air molecules 152 (or any other molecules) will generate gamma rays 154 (schematically depicted as wavy arrows in FIG. 7). Neutron beam 146 may become about 5-20 times wider (than when originally emitted from its corresponding beam transmission system) by the time it reaches the outer atmosphere. In some embodiments, the cross section of beam 146 passing through the atmosphere is in a range of 0.25 m-10 m in diameter. In general, however, the cross-section of beam 146 may have other sizes which may depend on the distances between the neutron source and the various collimating tubes.

Because of the width of beam 146, a large number of air molecules 152 may interact with neutrons 150 at or near tip 156 and sides 158 of beam 146. Air molecules 152 that penetrate into beam 146 may be deflected or broken up by collisions with neutrons 150. These collisions may create sub atomic particles 160 (schematically depicted as diamonds in FIG. 7), gamma rays 154 and other secondary radiation (not expressly shown). Most air molecules 152 do not penetrate too far into beam 146 because the high neutron density in beam 146. The deflected molecules 152 move at an angle relative to the direction of travel 148 of beam 146 and are forced to leave beam 146. Deflected molecules 152 may collide with other air molecules 152 and may prevent other molecules 152 from penetrating beam 146. Most of the secondary collisions happen in the area at or near the tip 156 and/or the sides 158 of beam 146 which may be referred to as pressure cloud 162. When beam 146 is moving through the atmosphere, the strongest part of beam 146 is in the region of this pressure cloud 162, which may help to preserve the neurons in the center and behind tip 156 of beam 146. In this manner, pressure cloud 162 may help to preserve the number of neutrons beam 146. It will be appreciated from the discussion above that optional insulating beam 124 may be used as a source of sacrificial neutrons on the sides 158 of beam 146 to help generate pressure cloud 162 on the sides 158 of beam 146 without using up neutrons 150 in the principal portion of beam 146.

In some embodiments, the satellites which house the neutron transmission systems described herein are in geosynchronous orbit or are otherwise moving relatively fast in orbit around the earth. In such embodiments, the neutron beams may move through the earth's atmospheric air (including clouds and/or the like) at relatively high velocity, potentially impacting the number of neutrons available in the beam (e.g. by collisions with air particles as described above). Accordingly, some embodiments may adjust the satellite speed or beam orientation (e.g. to a vertical or near vertical direction that aligns with a radius of the earth).

Figure 8A:
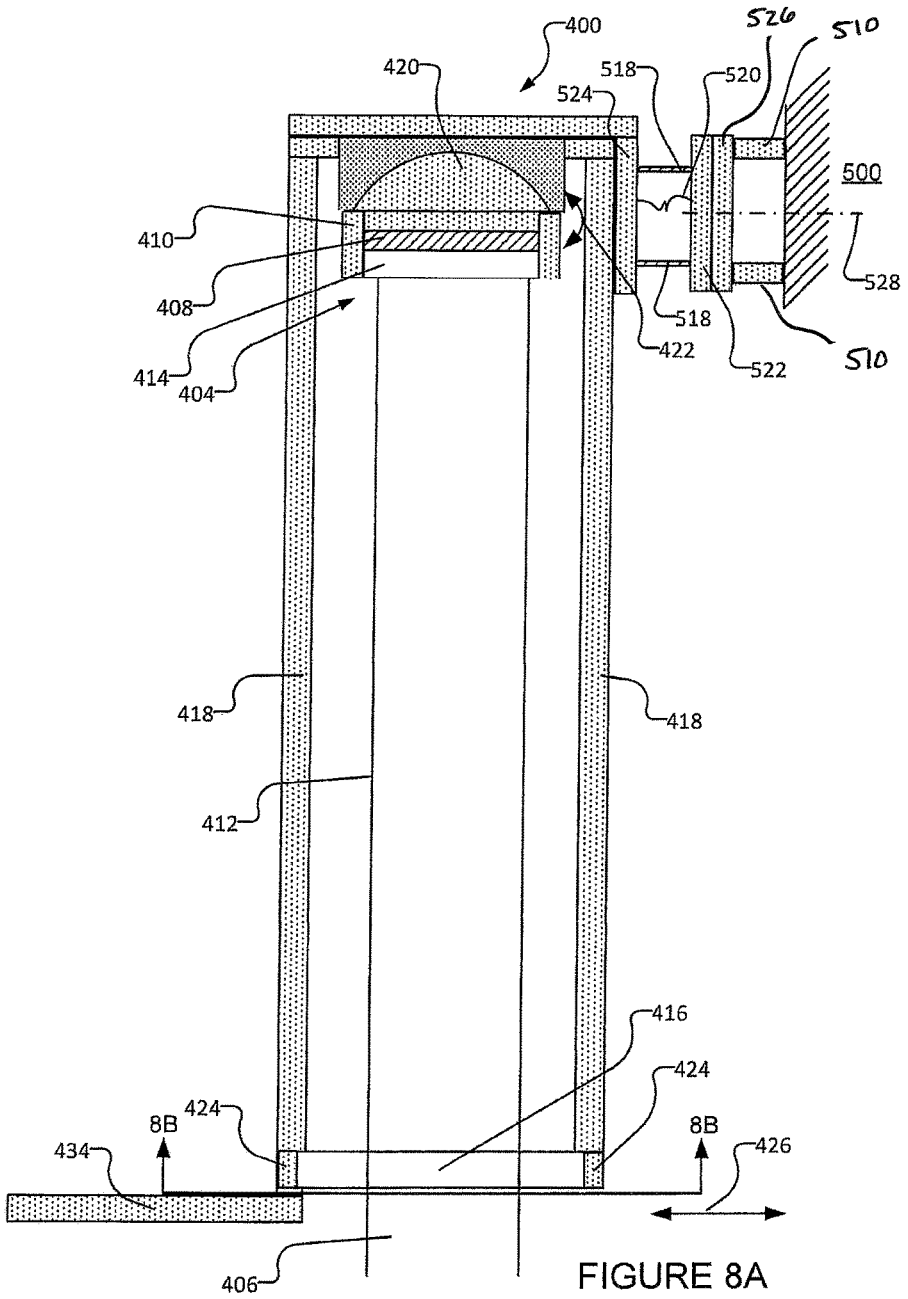
FIG. 8A is a schematic cross-sectional depiction of a neutron beam transmission system according to another embodiment.
Figure 8B:
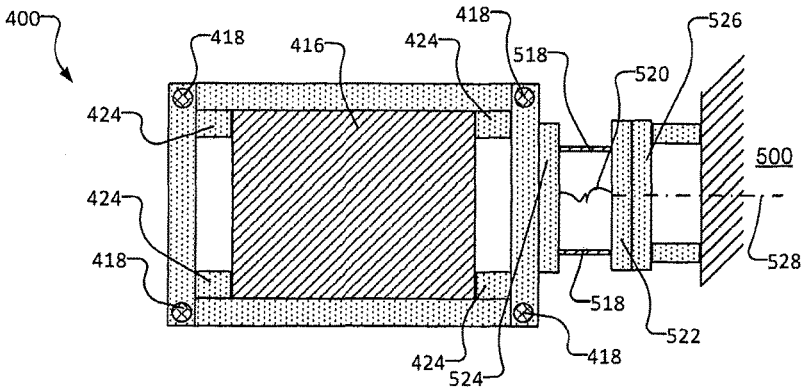
FIG. 8B is a front cross-sectional view of the FIG. 8A neutron beam transmission system taken along the like 8B-8B.
Figure 8C:
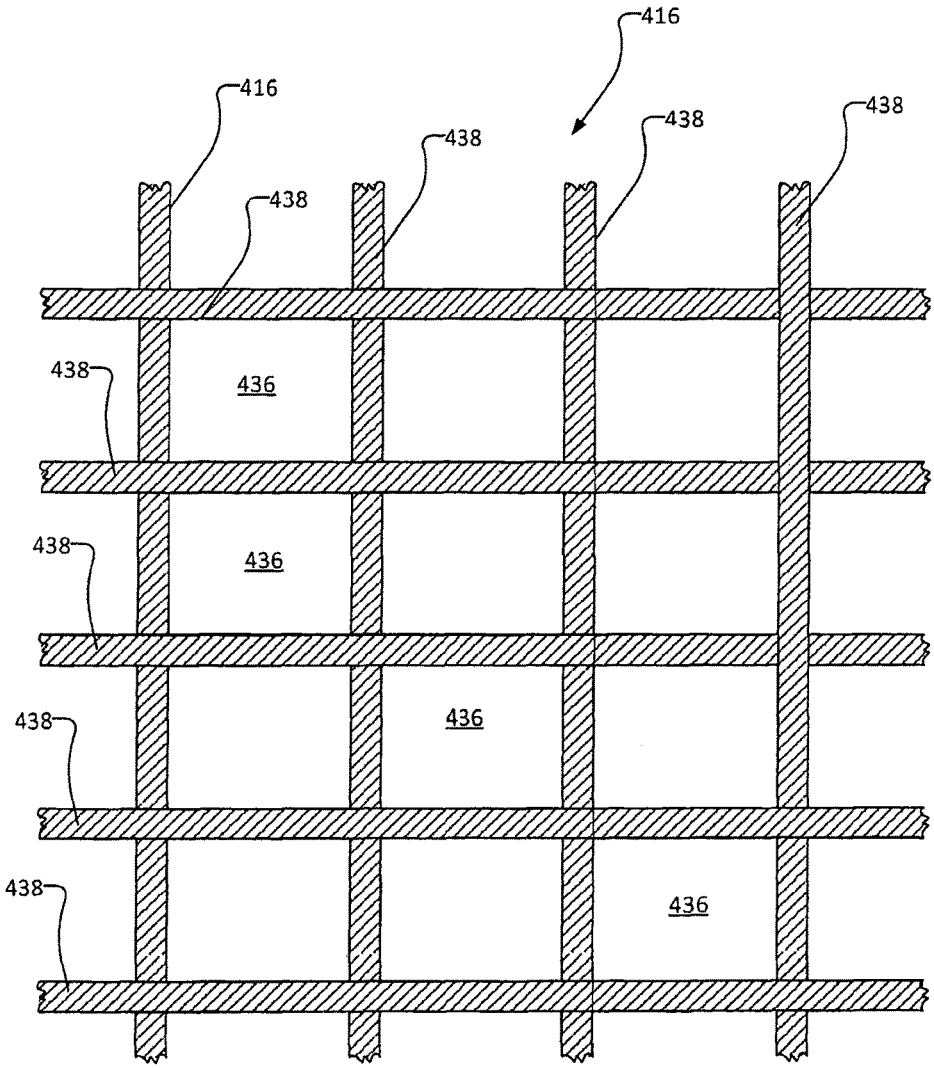
FIG. 8C is a beam's eye view of a portion of the filter plate of the FIG. 8A transmission system.

FIG. 8A is a side cross-sectional view of a neutron transmission system 400 according to another embodiment. FIG. 8B is a front cross-sectional view of neutron transmission system 400 taken along the line 8B-8B in FIG. 8A. FIG. 8C is a beam's eye view of a portion of the filter plate 416 of the FIG. 8A transmission system 400. Transmission system 400 of FIGS. 8A, 8B, 8C (together, FIG. 8) may be similar to the other transmission systems described herein and should be considered to have characteristics similar to those of the other transmission systems described herein, except where otherwise described. Transmission system 400 is used principally for a weapons application to create a large number of gamma rays which can disable digital electronics systems associated with enemy vehicles (e.g. aircraft), weapons guidance systems (e.g. of missiles) and/or the like. Gamma rays can also be lethal to humans and can cause nuclear powered weapons to explode. Transmission system 400 is relatively compact and can be made to move quickly to help strike moving targets.

To create a relatively large number of gamma rays, the neutron beam 406 generated by transmission system 400 can be expanded (relative to the other beams described herein—i.e. to have a high density of neutrons) so that there is a relatively large interaction of beam 406 with air particles or other particles, generating a correspondingly large number of gamma rays. This relatively large number of gamma rays means that beam 406 need only pass close to a target to damage the target, since destructive gamma rays can spread for distances up to a range of 100 m or more. Neutron beam may travel at speeds on the order of 20,000 km/second. Transmission system 400 may be best suited for attacking aircraft and missiles that have climbed to relatively high altitude (e.g. above thick cloud). Transmission system 400 may also be used to attack other facilities which rely on digital electronics and/or communications, such as command and control centers, bridges on naval ships and/or the like. Because of the rate that the neutron beam 406 of system 400, system 400 and its neutron beam 406 may be used to follow or track target aircraft and/or missiles (e.g. for several seconds). Further neutron beam 406 of system 400 may be configured to be on all of the time, so that it can keep re-aiming at target(s) without turning off beam 406.

Transmission system 400 differs from the other transmission systems described herein in that transmission system 400 is relatively short and does not include a narrow plate. Neutron transmission system 400 is mounted to a low orbit satellite 500, as will be described in more detail below. Neutron transmission system 400 comprises a beam generator 404 which, other than being relatively large, performs functionally similar to beam generator 104 in the embodiments described above to generate an initial neutron beam 412. Beam generator 404 comprises a radiation source provided by radioactive plate 408, which may be fabricated from uranium or other suitable radioactive source and which may be supported by frame 410. In some embodiments, radioactive plate 408 may have cross sectional dimensions on the order of 0.15 m-1 m×0.15 m-1 m and may have a thickness in a range of 0.5 cm-20 cm. Beam generator also comprises a lead plate 414 which is mounted in frame 410 and is apertured (not shown) to perform a function analogous to that of lead plate 202 described above. Lead plate 414 may have cross sectional dimensions on the order of those of radioactive plate 408 and may have a thickness in a range of 10−2 m-1 m, in some embodiments. In some embodiments, individual apertures may have cross-sections on the order of 103 μm2-2.5×104 μm2. In some embodiments, lead plate 414 is apertured with an aperture density in a range of 2×102-105 apertures per cm2. In some particular embodiments, the dimensions of the apertured region of plate 414 are in a range of 10−4 m2-1 m2 (e.g. to provide a total number of apertures in a range of 200-109). Like beam generator 104 described above, beam generator 404 provides a relatively collimated set of beamlets which together form initial neutron beam 412.

After being emitted from beam generator 404, initial neutron beam 412 impinges on filter plate 416. In some embodiments, filter plate 416 may be located in a range between 5 m-40 m from lead plate 414. Filter plate 416 may be fabricated from lead and may be apertured with apertures 436 (FIG. 8C) to perform a function analogous to that of wide plate 130 described above. In the illustrated embodiment, filter plate 416 is held in place by telescoping arms 418, which may extend when neutron transmission system 400 is active to emit neutron beam 406 but which may retract when neutron transmission system 400 is not in use (e.g. during launch of satellite 500). Telescoping arms 418 may also be used to adjust the distance between filter plate 416 and lead plate 414, to thereby change the cross-sectional dimensions of neutron beam 406. Adjustment to the cross-sectional area of beam 406 can assist when targets are outside of the atmosphere and relatively few gamma rays are generated prior to impacting the target, since it can then be desirable to hit the target directly with beam 406. In some embodiments, individual apertures in plate 416 may have cross-sections on the order of 103 μm2-2.5×104 μm2. In some embodiments, lead plate 416 is apertured with an aperture density in a range of 2×102 apertures per cm2-2×105 apertures per cm2. In some particular embodiments, the dimensions of the apertured region of plate 416 are in a range of 10−4 m2-1 m2 (e.g. to provide a total number of apertures in a range of 200-109). In some embodiments, the density of apertures 436 in filter plate 416 may be in a range of 200-1,200 apertures per cm2. Such apertures 436 may have cross-sectional areas in a range of 25 μm2-900 μm2. Portions 438 of filter plate 416 between apertures 436 may have cross-sectional dimensions on the order of 2 μm-20 μm. It will be appreciated that like the neutron transmission systems described above, beam 406 that is emitted from filter plate 416 may be relatively highly collimated and may travel large distances with a relatively small amount of cross-sectional spread.

Transmission system 400 may also comprise a lead transmission curtain 434 which may be moved in front of filter plate 416 to block the transmission of neutron beam 406 or may be moved out of the way (as shown in FIG. 8A) to facilitate the transmission of neutron beam 406.

Beam generator 404 may be mounted with a suitable mounting system 420 capable of adjusting the direction of initial neutron beam 412 (and ultimately-final neutron beam 406) in the directions of arrows 420. More particularly mounting system 420 may adjust the orientation of lead plate 414 in the directions of arrows 422. Mounting system-420 may permit very fine adjustment (e.g. on the order of thousandths of a degree or less) in the direction that initial beam 412 (and ultimately final neutron beam 406) is aimed. To accommodate changes in the orientation of initial beam 412, the mounts 424 which connect filter plate 416 to arms 418 may adjust the position of filter plate 416 in the directions of arrows 426. In addition to these fine adjustment changes, the entire transmission system 400 may be adjustably mounted to satellite 500 for larger scale adjustment of the orientation of beam 406.

Figure 9:
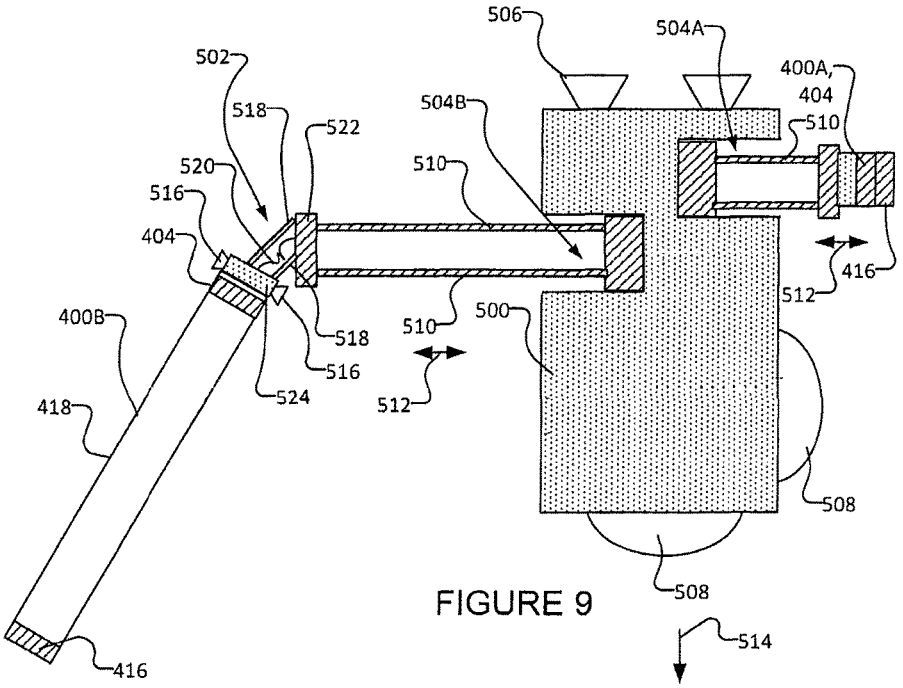
FIG. 9 is a schematic depiction of a satellite equipped with a plurality of the FIG. 8A neutron beam transmission systems.

FIG. 9 is a schematic depiction of a satellite 500 which is equipped with a plurality (e.g. two in the illustrated embodiment) of neutron beam transmission systems 400A, 400B (together, transmission systems 400) of the type described above in connection with FIG. 8. Satellite 500 may be orbiting in the direction indicated by arrow 514. As will be described in greater detail, neutron beam transmission systems 400 are coupled to satellite 500 by corresponding swiveling detachable couplings 502, which permit transmission systems 400 to fire at a corresponding plurality of targets at the same time. Transmission systems 400 may be housed within satellite 500 (e.g. in a compartments 504A, 504B) until such time as one or more of transmission systems 400 are needed.

Transmission systems 400 may be independently deployed. FIG. 9 shows a first transmission system 400A in a state of partial deployment and a second transmission system 400B which is fully deployed and ready to fire at a target. Satellite 500 may be equipped with rocket thrusters 506 for adjustment of the position and/or orientation of satellite 500 and with suitable sensors 508 for detection and/or tracking of targets (e.g. enemy missiles and/or aircraft being launched). Satellite 500 may also comprise communications equipment through which it may receive positional information about potential targets which may be used in addition to (or as an alternative to) sensors 508 for detection and/or tracking of targets.

Transmission systems 400 may be deployed by hydraulic arms 510 which may extend in the directions of arrows 512 to move transmission systems 400 away from satellite 500. Transmission system 400B has been extended away from satellite 500 by arms 510; transmission system 400A is partially extended away from satellite 500 on its arms 510. In addition to the extension of hydraulic arms 512, telescoping arms 418 of each transmission system 400 may be extended to separate its filter plate 416 from its beam generator 404 (see FIG. 8*a*). FIG. 9 shows the telescoping arms 418 of transmission system 400B extended in this manner, whereas the telescoping arms 418 of transmission system 400A are retracted so that its filter plate 416 is positioned adjacent to its beam generator 404.

As discussed above, transmission systems 400 may be connected to satellite 500 by detachable couplings 502. Once arms 510 are extended, transmission systems 400 may be separated from rigid contact with arms 510 and satellite 500. In particular, referring to FIG. 8*a*, components 522, 524 may separate from one another. This is shown in the FIG. 9 example of transmission system 400B, which is separated from rigid contact with satellite 500 and is connected to satellite 500 by retraction cables 518 and communications cables 520. Once decoupled, in this manner, rocket thrusters 516 may be used to move transmission systems 400 to adjust their orientation and to aim toward targets.

If both neutron beam transmission systems 400A, 400B are trying to aim at different targets, the vibrations created by one beam transmission system may have an impact on the accuracy of the other. When transmission systems 400 are detached from satellite 500 in this manner, their vibrational impact on one another may be minimized. As discussed above, couplings 502 may also be able to swivel. In particular, as shown in FIG. 8*a*, component 522 may be pivotable relative to component 526 about axis 528. Power may be provided from satellite 500 to transmission system 400 through an axial connection between components 522, 526. This pivotal action of couplings 502 may facilitate rapid adjustment of the orientation of transmission systems 400.

In operation, the following sequence may take place according to some embodiments. When a target (e.g. an enemy missile) is detected, a transmission system 400 is pushed out of its storage compartment 504 by hydraulic arms 510. The telescoping arms 418 move plate 416 away from neutron beam generator 404. The target is located and/or tracked using information from sensors 508 or based on information communicated to satellite 500 from other source(s) and transmission systems 400 are aimed at the target (e.g. using pivotal motion of pivotable plates 522, 526 and/or rocket thrusters 516 after decoupling of detachable plates 522, 524). At an appropriate time, lead transmission curtain 434 may then be moved out from in front of filter plate 416 to allow transmission of a neutron beam toward the target.

When the resultant neutron beam 406 impinges on the target or passes close to the target, the gamma rays generated by neutron beam 406 will disable the electronics associated with the target. In some cases where the target is a missile, neutron beam 406 will cause the missile's warhead to detonate. In some instances, neutron beam 406 may not cause the missile's warhead to detonate on a first pass. In such instances, the neutron beam transmission system 400 may be rotated 180°. This may be done by retracting cables 520, so that rotational components 522, 526 are re-attached to one another to facilitate pivotal motion about axis 528. Then transmission system 400 is detached again for accurate aiming using rocket thrusters 516, as before.

Where satellite 500 is equipped with a plurality of neutron beam transmission systems 400, they may be independently deployed to attack multiple targets.

Controller 504 may comprise components of a suitable computer. In general, controller 504 comprise any suitably configured processor, such as, for example, a suitably configured general purpose processor, microprocessor, microcontroller, digital signal processor, field-programmable gate array (FPGA), other types of programmable logic devices, pluralities of the foregoing, combinations of the foregoing, and/or the like. Controller 504 has access to software which may be stored in computer-readable memory (not expressly shown) accessible to controller 504 and/or in computer-readable memory that is integral to controller 504. Controller 504 may be configured to read and execute such software instructions and, when executed by the controller 504, such software may cause controller 504 to implement some of the functionalities described herein.

Certain implementations of the invention comprise controllers, computers and/or computer processors which execute software instructions which cause the controllers, computers and/or processors to perform a method of the invention. For example, one or more processors in a controller or computer may implement data processing steps in the methods described herein by executing software instructions retrieved from a program memory accessible to the processors. The invention may also be provided in the form of a program product. The program product may comprise any medium which carries a set of computer-readable signals comprising instructions which, when executed by a data processor, cause the data processor to execute a method of the invention. Program products according to the invention may be in any of a wide variety of forms. The program product may comprise, for example, physical (non-transitory) media such as magnetic data storage media including floppy diskettes, hard disk drives, optical data storage media including CD ROMs, DVDs, electronic data storage media including ROMs, flash RAM, or the like. The instructions may be present on the program product in encrypted and/or compressed formats.

Where a component (e.g. a software module, controller, processor, assembly, device, component, circuit, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

While a number of exemplary aspects and embodiments are discussed herein, those of skill in the art will recognize certain modifications, permutations, additions and sub combinations thereof.

While a number of exemplary aspects and embodiments have been discussed above, those of skill in the art will recognize certain modifications, permutations, additions and sub combinations thereof.

What is claimed is:

1. A neutron beam generating system comprising:

an orbiting satellite;

a neutron beam transmission tube on said satellite;

a neutron beam generator disposed within said neutron beam transmission tube, said neutron beam generator operable to emit neutron beamlets from a neutron source;

a first collimating plate disposed within said neutron beam transmission tube and downstream from said beam generator, said first collimating plate including a first array of collimating tubes through which said neutron beamlets are caused to pass through thereby forming secondary neutron beams; and a second collimating plate disposed within said neutron beam transmission tube and downstream from said first collimating plate, said second collimating plate including a second array of collimating tubes through which said secondary neutron beams are caused to pass through thereby forming a final neutron beam which is discharged from said neutron beam transmission tube.

2. The system of claim 1, wherein said beam generator comprises:

a lead plate having opposite sides, a thickness extending between said opposite sides, and a first aperture array of tubes extending through said thickness of said lead plate, said first aperture array of tubes being oriented toward said first array of collimating tubes of said first collimating plate;

said neutron source being disposed such that said lead plate is positioned between said neutron source and said first collimating plate; and said neutron source being supported and movable between first and second positions, wherein in said first position said neutron source at least partially positioned over first aperture array of tubes, and wherein in said second position said neutron source does not positioned over said first aperture array of tubes.

3. The system of claim 2, wherein said beam generator further comprises:

a rotatable arm, said neutron source attached to said rotatable arm; and a motor operatively connected to said rotatable arm to rotate said rotatable arm to position said neutron source between said first and second positions.

4. The system of claim 2, wherein at least one tube of said first aperture array of tubes is aligned with at least one collimating tube of said first array of collimating tubes.

5. The system of claim 1, further comprising:

a secondary neutron source supported by said first collimating plate and encircling said first collimating tube.

6. The system of claim 5, wherein said beam generator comprises:

a lead plate having opposite sides, a thickness extending between said opposite sides, and a first aperture array of tubes extending through said thickness of said lead plate, said first aperture array of tubes being oriented toward said first collimating tube of said first collimating plate;

said neutron source being disposed such that said lead plate is positioned between said neutron source and said first collimating plate; and said neutron source being supported and movable between first and second positions, wherein in said first position said neutron source at least partially positioned over first aperture array of tubes, and wherein in said second position said neutron source does not positioned over said first aperture array of tubes.

7. The system of claim 6, wherein said beam generator further comprises:

a rotatable arm, said neutron source attached to said rotatable arm; and a motor operatively connected to said rotatable arm to rotate said rotatable arm to position said neutron source between said first and second positions.

8. The system of claim 6, wherein at least one tube of said first aperture array of tubes is aligned with at least one collimating tube of said first array of collimating tubes.

9. The system of claim 1, wherein said neutron source is a radioactive material.

10. The system of claim 9, wherein said radioactive material is uranium.

11. A neutron beam generating system comprising:

an orbiting satellite;

a neutron beam transmission system on said orbiting satellite, said neutron beam transmission system including:

telescoping arms;

a neutron beam generator supported by said neutron beam transmission system at one end of said telescoping arms, said neutron beam generator operable to emit a neutron beam from a neutron source;

a filter plate supported at a second end of said telescoping arms at a spaced distance from said neutron beam generator and in alignment with a neutron beam emitted from said neutron beam generator; and wherein said telescoping arms are operable to increase or decrease said spaced distance between said neutron beam generator and said filter plate.

12. The system of claim 11, wherein said neutron beam generator is supported for rotational movement relative to said filter plate.

13. The system of claim 11, wherein said filter plate is supported for translational movement relative to said neutron beam generator.

14. The system of claim 11, further comprising:

transmission curtain disposed on said telescoping arms and being movable between first and second positions, wherein when in said first position said filter plate is covered by said transmission curtain, and wherein in said second position said filter plate is not covered by said transmission curtain.

15. The system of claim 11, wherein said a neutron beam transmission system is mounted to said orbiting satellite for movement relative to said orbiting satellite.

16. The system of claim 11, wherein said neutron beam transmission system is detachably mounted to said orbiting satellite and tethered to said orbiting satellite by one or more retraction cables and one or more communication cables.

17. The system of claim 11, wherein said neutron beam generator includes a radioactive source that emits neutrons.

* * * * *